United States Patent [19]

Ogawa

[11] 4,118,888

[45] Oct. 10, 1978

[54] ARTICULATED MAGNETIC DOLL

[75] Inventor: Iwakichi Ogawa, Chiba, Japan

[73] Assignee: Takara Co., Ltd., Tokyo, Japan

[21] Appl. No.: 725,941

[22] Filed: Sep. 23, 1976

[51] Int. Cl.[2] ..... A63H 33/26; A63H 13/16

[52] U.S. Cl. ..... 46/22; 46/145; 46/241; 124/16; 273/106 E

[58] Field of Search ..... 46/241, 145, 22, 206; 124/16, 37

[56] References Cited

U.S. PATENT DOCUMENTS

| | | | |
|---|---|---|---|
| 2,888,004 | 5/1959 | Steiner | 124/37 X |
| 3,108,395 | 10/1963 | Goldfarb | 46/145 |
| 3,191,342 | 6/1965 | Chalmers | 124/16 X |
| 3,961,440 | 6/1976 | Saito | 46/206 |
| 4,038,775 | 8/1977 | Sato | 46/22 |

FOREIGN PATENT DOCUMENTS

| | | | |
|---|---|---|---|
| 1,027,473 | 4/1958 | Fed. Rep. of Germany | 46/241 |
| 1,032,613 | 6/1956 | Fed. Rep. of Germany | 46/241 |
| 514,679 | 2/1955 | Italy | 46/22 |

*Primary Examiner*—F. Barry Shay

*Attorney, Agent, or Firm*—Harold L. Jackson; Stanley R. Jones; Joseph W. Price

[57] ABSTRACT

A versatile articulated magnetic toy having removable appendages is provided. Body shells encapsulate a magnet and pair of armature plates. The armature plates include beveled edges to form joints and are retained on either side of the magnet by the magnetic flux. The magnet is hollow and can be aligned by the respective body shells and can further accommodate a chest cavity projectile firing mechanism. The appendages advantageously resemble humanoid arms and legs. An arm appendage can include a spring-loaded firing mechanism capable of discharging the first portion of the arm as a projectile. The ease with which the appendages can be removed permits the addition of various accessories to form modified toy assemblies.

16 Claims, 3 Drawing Figures

ARTICULATED MAGNETIC DOLL

BACKGROUND OF THE INVENTION

1. Field of the Invention

The present invention is directed to a magnetic toy having removable appendages and more particularly to an articulated toy doll having an interior magnet securing a pair of armature plates.

2. Description of the Prior Art

Magnets have been utilized in the toy industry for various purposes such as adhering magnetizable members to a basic structure.

Examples of magnetized structures in the toy industry can be found in the Gordon U.S. Pat. No. 3,090,155 and in the Yonkers U.S. Pat. No 2,970,388. Under examples of magnetic structures for retaining removable items can be found in the Budreck U.S. Pat. No. 3,041,697 and the Italian Pat. No. 514,679 directed to a magnetized life-size manikin.

It is always a goal of the prior art to provide an easily assembleable and relatively inexpensive construction to meet the highly competitive demands of the toy industry. Likewise, an additional goal is to provide unique and novel features which appeal to children.

SUMMARY OF THE INVENTION

The present invention provides an articulated toy utilizing a magnetic force for retaining removable appendages. A hollow magnet can be operatively positioned within body housing shells. Held to the magnet by its magnetic flux are a first and second armature plate having joint portions formed there between with beveled cuts. The joint portions secure the appendages in any desired position.

Preferably, the articulated toy has a humanoid appearance and the appendages can simulate arms and legs. At least one of the appendages can contain a manually operated firing mechanism for discharging a portion of the simulated appendage as a projectile. For example, an arm appendage can contain a spring loaded mechanism within its forearm for firing a projectile fist. Additionally, the body cavity can also include a spring loaded projectile firing mechanism. Since the appendages are removable, accessory toy items can be appended to the body and various subcombinations of toy assemblies are possible, limited only by the imagination of the child.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE PREFERRED EMBODIMENTS

Figures 1, 2, 3:
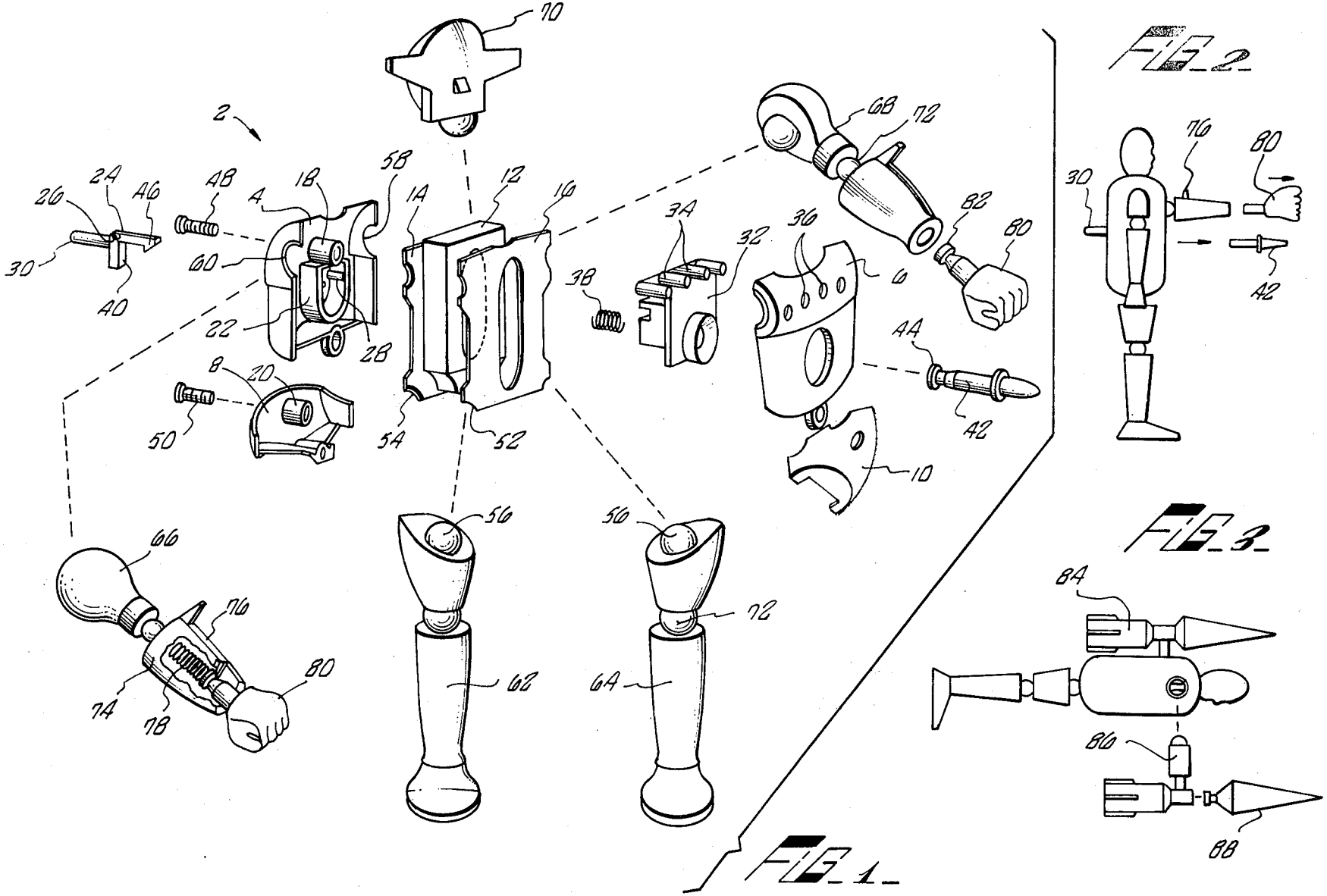
FIG. 1 is an exploded perspective view of an articulated toy of the present invention.
FIG. 2 is a side perspective view of an articulated toy doll.
FIG. 3 is a side view of a modified articulated toy doll of the present invention.

The following description is provided to enable persons skilled in the toy industry to make and use the invention and sets forth the best modes contemplated by the inventor of carrying out his invention. Various modifications, however, will remain readily apparent to those skilled in the art, since the generic principles of the present invention have been defined herein specifically to provide a toy assembly that can be manufactured in a relatively economical manner. The mode of the present invention specifically described in the accompanying drawing is in the form of a mechanical or robot man. Variations of this design structure to provide other forms of toy designs within the parameters of the present invention is possible.

Referring to FIG. 1, an articulated toy assembly in the form of a robot doll is disclosed in an exploded perspective. The body of the doll encapsulates magnetic means for providing magnetic flux to retain appropriate appendages. The exterior body or hollow housing 2, includes a pair of housing half shells or breast members 4 and 6 a pair of waist half shells 8 and 10. Aligned within the exterior body structure is a hollow or apertured magnet 12 and a pair of armature plates 14 and 16.

The armature poles or plates 14 and 16 are identically cut from a sheet of thin steel and having a central opening corresponding to the configuration of the cavity in the hollow magnet 12. Arcuate cuts 52 on the periphery of the respective plates are aligned so that an arcuate cut on one plate will form a joint portion with an arcuate cut on the other plate. These joint portions have a beveled edge 54 that are complimentary to the spherical configuration of the ball joints 56 that are mounted on respective appendages to be subsequently discussed.

An alignment post 18 on the rear half shell 4 and a corresponding alignment post 20 on the waist half shell 8 are designed to position the magnet 12 and the respective armature plates 14 and 16 within the body 2. These respective mounting posts can be positioned either on the front half shell 6 or on the rear half shell 4.

The rear breast half shell 4 further includes an alignment receptacle 22 for receiving a firing actuator 24. A pair of pins 26 on the actuator 24 are designed to rest on alignment shoulders 28 in the alignment receptacle 22.

Breast half shells 4 and 6 include appropriate semicircular peripheral edge openings 58 that have a complimentary beveled edge 60 of approximately the same common radius of curvature as the beveled edge 54 on the arcuate cuts 52. Thus, a spherical configuration complimentary to the spherical ball joints 56 on the appendages are provided to provide an adequate contact for the transmission of magnetic flux and for relative freedom of movement of the appendage.

An actuator lever 30 extends through and exteriorly of the rear half shell 4. A firing mechanism 32 is aligned with the breast half shell 6 through a series of alignment pins 34 that extend through a series of holes 36 in the front half shell 6. The firing mechanism 32 also extends through the cavity of the magnet 12 and mates with the alignment receptacle 22 to capture an actuator spring 38.

The actuator spring 38 seats against a shoulder 40 on the actuator 24. The spring 38 biases the lever 30 in an upper vertical direction about its pins 26. When the spring is depressed by the insertion of a projectile such as the rocket 42, a disk 44 on the rocket will cam a hook 46 of the actuator 24 upward until it passes inwardly and permits the hook 46 to capture and retain the projectile 42 against the bias of the spring force. A vertical downward depression of the actuator 30 will release the hook 46 and accordingly, permit the rocket to be propelled by the spring energy as shown in FIG. 2.

The respective breast half shells and waist half shells can be held together by screws 48 and 50 respectively. Alignment pins and complimentary holes (not shown) can be provided on the various half shells as known in the art. Preferably the half shells are plastic parts.

As disclosed in each of the figures, the preferred embodiment of the present invention is a humanoid or robot-like shaped toy. In this regard, the appendages have some simulation to that of a human; that is, a pair of legs 62 and 64, a pair of arms 66 and 68 and a head 70 are provided. Both the arm and leg appendages are further individually articulated with movable joints or hinges 72.

The arm appendages 66 and 68 are additionally novel in that the forearm housing 74 of each arm appendage includes a projectile firing mechanism. In this regard a hooked lever 76 somewhat analogous to the chest actuator 24 is pivotally mounted in a longitudinal slot in the forearm 74. A compression spring 78 is mounted against a shoulder on the lever 76.

A simulated fist projectile 80 has a rear extending shaft terminating in a disk 82 that is capable of camming the hooked end of the lever 76 upward to be fastened by the hook. By the appropriate depression of the lever 76, the spring energy is released and the fist projectile 80 is fired. Referring to FIG. 2 a schematic of the present invention is disclosed with both the rocket projectile 42 and the fist projectile 80 being fired.

FIG. 3 discloses a further modification of the present invention wherein an accessory simulated rocket attachment 84 can be mounted directly on the back of the exterior body 2 or with an adaptor 86 attached directly to an arm socket joint. The cone shaped portion 88 of the rocket can be removable and can also form a projectile for firing from either the chest or forearms of the toy.

Finally, the armature plates 14 and 16, shown in FIG. 1, are held in place by the flux of the magnet 12. The beveled cuts 54 on the joints 52 insure an adequate surface contact with the spherical joints 56 of each of the appendages. This contact is sufficient to permit an optional placement of the appendage at any rotational position with the assurance that it will remain relatively stationary.

The present invention not only provides a unique and versatile toy, but it permits a relatively inexpensive construction with a minimum of manufacturing problems. Since various modifications can be made within the scope of the present invention by a person skilled in the toy industry, the present invention should be measured solely from the following claims in which I claim.

What is claimed is:

1. An articulated toy having removable appendages comprising;

a hollow housing having at least front and rear shell members;

a magnet having an aperture operatively positioned within the hollow housing;

a pair of armature plates operatively connected to said magnet, at least one joint portion being formed between the armature plates to receive a complimentarily shaped joint on an appendage; and means for securing said housing shell members and aligning said magnet and armature plate, said means extending through the magnet aperture to interconnect said shell members.

2. The invention of claim 1 wherein the means for securing and aligning includes at least one alignment post.

3. The invention of claim 1 further including a plurality of holes on the front shell and a firing mechanism capable of projecting a simulated rocket further having a plurality of alignment pins extending through said shell holes.

4. The invention of claim 1 further including an arm appendage including a firing mechanism capable of projecting an object and a fist projectile having one end configured to simulate a closed fist and the other end formed into a shaft member with a retaining disk for engaging the firing mechanism.

5. The invention of claim 1 wherein an arm appendage includes a firing mechanism for discharging the fist portion as a projectile.

6. An articulated toy having removable appendages comprising;

a hollow housing including a first and second breast member and a first and second waist member;

a magnet having an aperture being operatively positioned by the housing;

a first and second armature plate attached to respective sides of the magnet only by its magnetic flux, at least one joint portion formed between the armature plates to receive a complimentarily shaped joint on an appendage;

means for detachably securing said housing members about said magnet and armature plates, and a spring loaded projectile firing mechanism having an actuator is mounted within the housing, the actuator extending through the magnet aperture and housing to permit actuation exterior of the housing.

7. The invention of claim 6 further including an arm appendage having a firing mechanism for discharging the fist portion of the arm as a projectile.

8. The invention of claim 6 further including a plurality of appendages configured and positioned to represent respectively arms, legs and a head member.

9. The invention of claim 2 wherein the joint portion is formed by beveled edges of the first and second armature plates.

10. An articulated magnetic doll capable of firing projectiles comprising;

a hollow housing having at least a front and rear shell member, said front shell having at least one alignment hole and said rear shell having a firing mechanism alignment receptacle;

a magnet having an aperture operatively positioned within the hollow housing;

armature plate joint means operatively connected to said magnet to provide at least one joint portion to receive a complimentarily shaped joint on an appendage;

a projectile, and a firing mechanism for propelling said projectile having an actuator extending through said rear shell, said firing mechanism extending through said magnet aperture to operatively connect with said rear shell firing mechanism alignment receptacle and further having an alignment member for insertion within said alignment hole in said front shell.

11. The invention of claim 10 further including second means for discharging projectiles.

12. The invention of claim 11 wherein the second means for discharging projectile includes a spring loaded removable appendage simulating an arm.

13. The invention of claim 10 further including an appendage configured to represent an arm including a second firing mechanism capable of projecting an object and a fist projectile having one end configured to simulate a closed fist and the other end formed into a shaft member with a retaining disk for engaging the second firing mechanism.

14. The invention of claim 13 wherein said armature plate joint means includes a pair of armature plates having an oblong slot complimentarily to said magnet aperture.

15. The invention of claim 13 wherein said arm appendage further includes a hinge member between said joint means and said firing mechanism to permit relative movement.

16. An articulated magnetized toy doll having removable appendages comprising:

a hollow body member having a first and second breast member and a first and second waist member;

hollow magnetic means operatively positioned within the body member for removably retaining the articulated appendages;

a first spring-loaded projectile firing mechanism having an actuator being mounted within the body member, the actuator extending through the hollow magnetic means to permit actuation exterior of the body member;

a plurality of removable appendages simulating humanoid arms and legs, at least one arm appendage containing joint means for articulated connection with said magnetic means;

a second manually operated firing mechanism for discharging a portion of the simulated appendage as a projectile having an exterior actuator lever, and a projectile configured and positioned on the second firing mechanism to simulate a closed fist at one end, the other end of the projectile formed into a shaft member with a retaining disk for releasable engagement with the second firing mechanism.

* * * * *

UNITED STATES PATENT AND TRADEMARK OFFICE

CERTIFICATE OF CORRECTION

PATENT NO. : 4,118,888

DATED : October 10, 1978

INVENTOR(S) : Iwakichi Ogawa

It is certified that error appears in the above-identified patent and that said Letters Patent are hereby corrected as shown below:

In the Abstract, line 11 delete "first" and insert --fist--.

Col. 4, line 22 delete "being" and insert --is--.

Col. 6, line 5 delete "being" and insert --is--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*